United States Patent [19]

Paschal, Jr. et al.

[11] Patent Number: 4,685,523

[45] Date of Patent: Aug. 11, 1987

[54] REMOVABLE SIDE POCKET MANDREL

[75] Inventors: James H. Paschal, Jr., Dallas, Tex.; Oscar H. Freiman, Anchorage, Ak.; Dickie L. Kernal, Carrollton, Tex.

[73] Assignee: Otis Engineering Corporation, Dallas, Tex.

[21] Appl. No.: 860,366

[22] Filed: May 6, 1986

[51] Int. Cl.[4] ..... E21B 23/03

[52] U.S. Cl. ..... 166/378; 166/117.6; 166/146; 166/186; 166/387

[58] Field of Search ..... 166/117.5, 117.6, 146, 166/186, 297, 372, 378, 386, 387

[56] References Cited

U.S. PATENT DOCUMENTS

| | | | |
|---|---|---|---|
| 2,393,404 | 2/1946 | Otis | 166/2 |
| 2,687,775 | 8/1954 | Baker | 166/63 |
| 3,215,208 | 11/1965 | Tamplen | 277/116.8 |
| 3,278,192 | 10/1966 | Tamplen | 277/116.2 |
| 3,496,953 | 2/1970 | Garrett | 166/55.1 |
| 3,626,969 | 12/1971 | Garrett | 166/386 |
| 3,844,352 | 10/1974 | Garrett | 166/297 |
| 4,295,796 | 10/1981 | Moore | 166/117.5 |
| 4,333,527 | 6/1982 | Higgins et al. | 166/117.5 |

*Primary Examiner*—Stephen J. Novosad
*Assistant Examiner*—Terry Lee Melius
*Attorney, Agent, or Firm*—Albert W. Carroll

[57] ABSTRACT

Downhole apparatus for converting conventional petroleum wells to gas lift or chemical injection operation by perforating the well tubing at the desired depth and thereafter installing a packoff anchor within the well tubing, without disturbing the setting thereof, to bridge the perforation, the packoff anchor having an elongate tubular body with a lateral flow port in its wall, seals above and below the flow port for sealing with the well tubing above and below the perforation, and a receptacle for receiving a flow control device, such as a gas lift valve or injection valve for controlling flow through the lateral port. Fluids, such as lift gas or treating fluids injected into the annulus at the surface enter the flow stream inside the well tubing through the perforation and lateral flow port but under control of the flow control device. Preferably this elongate tubular body is a side pocket mandrel, and that preferably of the orienting type. Any number of such packoff anchors may be installed in a well and flow control devices may be installed in or removed from them in any desired order. Means are disclosed for removably securing the packoff anchors in the tubing. Installations utilizing such packoff anchors are disclosed together with various methods for completing such installations.

25 Claims, 25 Drawing Figures

REMOVABLE SIDE POCKET MANDREL

BACKGROUND OF THE INVENTION

1. Field of the Invention

This invention relates to wells and their operation through artificial lift practices, and more particularly, relates to gas lift wells and equipment and methods relating thereto.

2. Background Art

Packoff anchors have been used for many years for sealing or bridging across an opening such as a port (for instance, a perforation, a flow port of a sliding sleeve valve, a leak, or the like) in the wall of well tubing and still permit the flow of well production fluids to the surface through the tubing.

A packoff anchor installation generally includes a stop which is releasably locked or otherwise secured in the well tubing just below the hole to be bridged or sealed off, a packoff anchor which is generally a spacer pipe of suitable length having seal means at its opposite ends which, when the packoff anchor is supported on the stop, seal with the inner wall of the tubing both above and below the hole. Thus, the packoff anchor bridges across or isolates the holes and prevents the flow of fluids between the tubing and the exterior thereof.

Often the packoff anchor has means on its lower end for latching onto the stop to help hold it anchored in place. Since packoff anchors tend to be forced to the surface during production of the well, it is common practice to place a second stop against its upper end to positively secure it in place and, thus, prevent such occurrence.

The following U. S. Patents are familiar to the applicants and each one possibly has some pertinence relative to the invention claimed herein.

| | | |
|---|---|---|
| 2,393,404 | 2,687,775 | 3,215,208 |
| 3,278,192 | 4,333,527 | |

U.S. Pat. No. 2,393,404 issued Jan. 22, 1946 to Herbert C. Otis and discloses methods and means for placing a well on "gas lift" without disturbing the well tubing by setting a stop in the well tubing, supporting a perforator on the stop, perforating the wall of the tubing a short distance above the stop, removing the perforator, and then installing a removable packoff anchor having one or more orifices in its wall between its upper and lower seals which sealingly engage the tubing above and below the perforation. These orifices control the admission of lift gas into the well flow stream, this lift gas flowing from the annulus into the tubing through the perforation and then through the one or more orifices into the production fluids to aid in lifting such fluids to the surface. The packoff anchor is retrievable from the well with wire line and suitable retrieving tools.

U.S. Pat. No. 2,393,404 also teaches the use of a circulating plug for setting on top of the tubing stop prior to perforating so that, after the perforation has been made, water or other cleaning fluid can be circulated down the tubing, through the perforation, and up the annulus to the surface to clear the annulus of mud, or the like, preparatory to injecting lift gas into the annulus at the surface. The circulating plug will not allow such cleaning fluids to flow downwardly beyond it but forces such fluids to exit the tubing through the perforation into the annulus for its return trip to the surface.

U.S. Pat. No. 3,215,208 issued to Jack W. Tamplen on Nov. 2, 1965 and discloses the use of a gas lift valve in a retrievable packoff anchor. The gas lift valve illustrated is of the concentric type and serves as the spacer for spacing the upper and lower seals. The elements and seal devices of the packoff anchor are essentially the same as those used on one embodiment of the present invention. The gas lift valve may be retrieved only by retrieving the packoff anchor.

U.S. Pat. No. 3,278,192 which issued to Jack W. Tamplen on Oct. 11, 1966 teaches sealing elements for packoff anchors, and the like equipment, such as disclosed in U. S. Pat. No. 3,215,208.

U.S. Pat. No. 2,687,775 issued on Aug. 31, 1954 to Reuben C. Baker. This patent discloses a downhole setting tool for well packers, which setting tool is powered by gas generated by a powder charge therein detonated from the surface by electricity. The pressure of the gas acts through a piston/cylinder to apply opposing axial forces of considerable magnitude to a downhole tool such as a well packer. Such tools are commonly known as setting guns and may be used to set tools other than well packers.

U.S. Pat. No. 4,333,527 issued June 8, 1982 to Robert S. Higgins and David T. Merritt. This patent discloses an improved side pocket mandrel. The side pocket mandrel of this patent is but one of many side pocket mandrels which could be used in practicing the present invention.

U.S. Pat. Nos. 2,393,404; 2,687,775; 3,215,208; 3,278,192; and 4,333,527 are hereby incorporated herein by reference thereto for all purposes.

None of the prior art patents with which the inventors are familiar teaches a side pocket mandrel installed wholly within the bore of a well tubing or one forming a part of a packoff anchor within a well tubing. Neither are the inventors aware of any teaching in the prior art which relates to use of a removable flow control device installed within the bore of a packoff anchor body.

SUMMARY OF THE INVENTION

The present invention is directed to methods of and apparatus for preparing a well for gas lift or similar operation, such as chemical injection, or the like, by providing a packoff anchor including a body or a side pocket mandrel, having a lateral flow port therein, and seal means above and below the lateral port, and providing means for securing the packoff anchor within the bore of the well tubing with the seal means engaging the well tubing both above and below a perforation or port in the wall of the well tubing. This invention eliminates the need for installing expensive side pocket mandrels and dummy valves in wells having large bore well tubing when the wells are completed, especially when the wells may produce for years before they will require artificial lift operations for continued production.

It is therefore one object of this invention to provide a method of preparing a well for gas lift or similar operation by perforating the well tubing at a desired depth and then removably securing a packoff anchor which may include a side pocket mandrel opposite the perforation and sealing between the packoff anchor and the well tubing both above and below the perforation.

Another object is to provide such a method which includes perforating the tubing in a plurality of locations and securing a packoff anchor including a side pocket mandrel for controlling fluid flow through each perforation.

Another object is to provide a method forming a plurality of perforations at longitudinally spaced-apart locations in the well tubing during one trip of the perforator into the well, and during subsequent trips thereinto setting a packoff anchor opposite each such perforation for controlling flow therethrough.

Another object is to provide such a method including circulating cleanout fluids through said perforation prior to installing the packoff anchor to thus clear the tubing-casing annulus of unwanted fluids.

Another object is to provide such a method including installing a tubing stop at a desired location in the tubing, running a perforator and perforating the well tubing while the perforator is in contact with the stop, removing the perforator, then installing a packoff anchor, which includes a side pocket mandrel, sealing between the side pocket mandrel and the tubing both above and below the perforation, and controlling flow through the perforation.

Another object is to provide methods which include installing control devices in such side pocket mandrels of such packoff anchors either before or after such packoff anchors are installed in the well.

Another object is to provide a packoff anchor having a tubular body having a lateral port in its wall and a receptacle for removably receiving a flow control device within the body for controlling flow through the lateral port.

Another object is to provide a packoff anchor including a side pocket mandrel having a lateral flow port therein and sealing means carried thereon above and below the lateral flow ports.

Another object is to provide such a packoff anchor having means thereon for securing the packoff anchor in a well tubing.

A further object is to provide such a packoff anchor having securing means attached to either end thereof, which packoff anchor and securing means can be run into the well tubing in one piece.

Another object is to provide such a packoff anchor wherein the securing means is not attached thereto but is run into the well separately thereof.

A further object is to provide a side pocket mandrel having a lateral flow port for installation inside a well tubing, said side pocket mandrel having means for sealing with the well tubing above and below its lateral flow port.

Another object is to provide a side pocket mandrel for bridging a hole or port in a well tubing, said side pocket mandrel having seal means for sealing with the well tubing above and below its hole or port and having means associated therewith for securing the side pocket mandrel in proper position in the well tubing.

Another object is to provide well installations for converting a conventionally completed well to gas lift, or the like, operation.

Another object is to provide such well installations wherein flow control devices may be installed in or removed from the packoff anchor either before or after it has been installed in the well.

Another object is to provide such well installations having a plurality of packoff anchors installed therein and wherein the flow control devices in the packoff anchors are installable or removable in any selected order.

Other objects and advantages will become apparent from reading the description which follows and from studying the accompanying drawing, wherein:

BRIEF DESCRIPTION OF THE INVENTION

FIG. 1 is a schematical view showing a conventional well which has been converted to gas lift or similar operation in accordance with the present invention, there being shown two side pocket mandrels secured and sealed at spaced-apart downhole locations in the bore of the well tubing;

FIGS. 2A–2F taken together constitute a longitudinal view, partly in section and partly in elevation, showing one form of apparatus constructed in accordance with the present invention;

FIG. 3 is a cross-sectional view taken along line 3—3 of FIG. 2F;

FIGS. 4A–4E taken together constitute a longitudinal view, partly in section and partly in elevation, showing another form of apparatus constructed in accordance with the present invention;

FIG. 5 is a cross-sectional view taken along line 5—5 of FIG. 4A, the garter spring being omitted for clarity;

FIG. 6 is a cross-sectional view similar to FIG. 5 but taken along line 6—6 of FIG. 4E, the garter spring being omitted for clarity, FIGS. 7–13 are schematical views showing, step by step, a method (or methods) of installing apparatus of the present invention in a well to convert such well to gas lift or similar operations; and FIGS. 14–16 are schematical views showing, step by step, a method of installing a slightly different form of apparatus of the present invention in a well.

DESCRIPTION OF THE PREFERRED EMBODIMENTS

Figure 1:
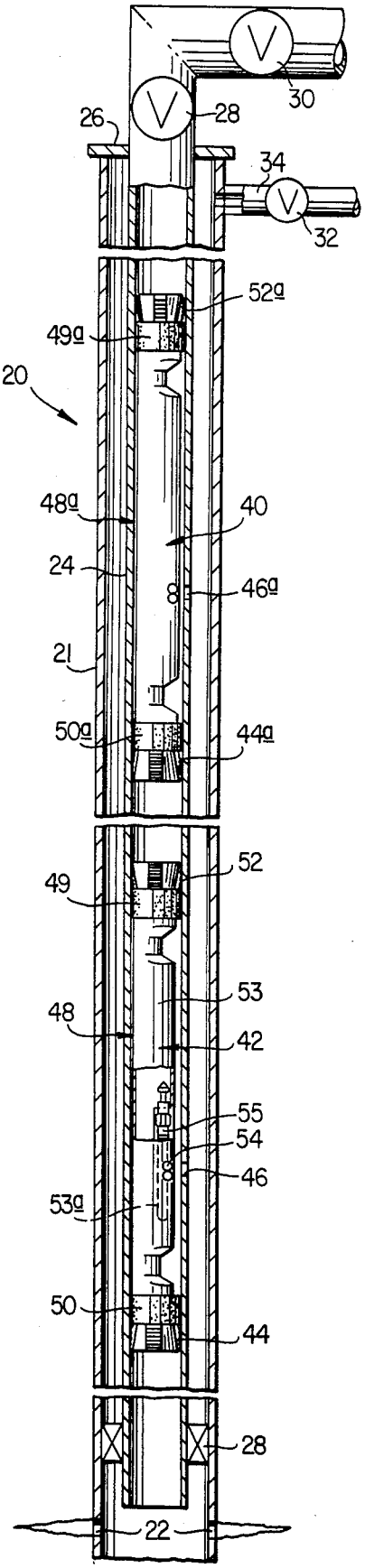

Referring now to FIG. 1, it will be seen that the well 20 is provided with a well casing 21 which extends from the surface to a subterranean formation opposite which the casing is perforated as at 22. The well is equipped with a string of well tubing 24 disposed within the casing 21, and this tubing string is sealed therearound at the surface by the wellhead 26 while a packer 28 seals between the exterior of the tubing and the interior of the casing at a location above the perforations 22. The well 20 is shown to be provided with the customary master valve 28 and wing valve 30 for controlling the flow of well fluids through the tubing. The well casing 21 is provided with a wing valve 32 for controlling the flow of fluids through the casing wing 34.

Formerly, well 20 would produce production fluids from the formation entering the casing 21 through perforations 22 and flowing upwardly through the bore of the well tubing 24 to the surface. Subsequently, the pressure of the formation has subsided to such extent that it was no longer sufficient to force the production fluids to the surface, and the well stopped flowing. The well was then converted to gas lift operation as illustrated in FIG. 1 and in a manner which will now be described.

Well 20, as seen in FIG. 1, is equipped with two packoff anchor devices 40 and 42, but it should be understood that more such devices could be used if necessary. More than one is required in most cases, but one may be sufficient under ideal conditions. To prepare the installation, it must be determined where to place the gas lift valves in converting the well to gas lift operation. Such determinations are commonly made, and the procedure for doing so is well known in the art. Having determined where the lowermost gas lift valve is to be located, a lower or first stop 44 was set in the tubing 24 after which a well perforator (not shown) was placed on top of the stop 44 and the tubing perforated as at 46. The perforator was withdrawn from the well, and a packoff anchor composed of an elongate body, in this case a side pocket mandrel 48, having upper and lower resilient expansible seals 49 and 50 thereon was lowered into the well and placed on top of this first stop 44. Normally, the packoff anchor 42 would have means thereon for latching into the lower stop 44. When the packoff anchor 42 was installed, the seals 49 and 50 were expanded into sealing engagement with the surrounding tubing wall. Next, the upper or second stop 52 was run into the tubing string and locked in place against the upper end of the packoff anchor 42. The packoff anchor 42 was now confined between the two stop assemblies 44 and 52 and cannot move in either longitudinal direction.

The side pocket mandrel 48 has a belly 53 and an offset receptacle bore **53*a* opening into said belly. One or more lateral ports such as the lateral port 54 communicates the receptacle bore with the exterior of the side pocket mandrel and therefore with the tubing perforation 46. It is important that the seals 49 and 50 of the packoff anchor 42 seal both above and below the perforation 46. This of course is assured by placing the perforating gun on top of the lower stop 44 at the time that the perforation is made. In this manner, the perforation 46 is a known distance above the lower stop, and the packoff anchor can be at least sufficiently long to place its upper seal 49 above the perforation 46 and thus assure that the lateral ports 54 will communicate with the perforation 46**.

The gas lift valve 55 which is received in the receptacle bore **53*a* of the side pocket mandrel may be installed on the surface and run into the well in the side pocket mandrel. However, it may be preferable to run the side pocket mandrel into the well with the offset receptacle thereof empty. If so, after the upper stop 52 is installed, the gas lift valve or other flow control device may be run into the well on a suitable string of wireline tools including a suitable kickover tool and the flow control device installed in the offset receptacle in order to control the flow of fluids through the perforation 46 and the lateral ports 54**.

In the same manner, the packoff anchor 40 and any additional packoff anchors are installed.

Packoff anchor 40 may be exactly like packoff anchor 42, having a side pocket mandrel **48*a*, upper and lower seals 49*a* and 50*a* sealing above and below perforation 46*a*, and upper and lower stops 52*a* and 44*a***.

After the packoff anchors are installed and the flow control devices are in place in the side pocket mandrels, the well 20 can be gas lifted in the manner well known in the art by injecting lift gas into the casing wing 34 and through the wing valve 32 into the tubing-casing annulus above the well packer 28. This lift gas will enter the perforations and will flow through the lateral ports of the side pocket mandrels and through the gas lift valves therein into the tubing to aerate the column of production fluids rising therein to aid in lifting such fluids to the surface. Ordinarily, the lowermost gas lift valve is the one through which the gas from the annulus passes into the tubing for lifting the production fluids to the surface. The higher gas lift valves are generally used for unloading the well and getting started as is well known in the art.

Thus, it is seen that the well 20 which had stopped flowing because its insufficient bottom hole pressure has been placed on gas lift without disturbing the tubing string. This was accomplished by perforating the well tubing and by installing side pocket mandrels and gas lift valves therein to control the lift gas entering the well tubing through these perforations for aiding the production fluids in flowing to the surface.

It may readily be seen that since these side pocket mandrels contain removable flow control devices such as gas lift valves, or the like, such flow control devices can be removed and replaced in the well-known manner by running a wire line into the well with a suitable string of tools including kickover tool and pulling tool to selectively remove any one or more of the devices from the gas lift mandrels in any order and replace them in any order. It may be necessary only to change the lowermost valve when it becomes worn. If so, the string of wireline tools and kickover tool is run through all of the side pocket mandrels thereabove, and the flow control device or gas lift valve is engaged and removed from the lowermost side pocket mandrel and replaced in the usual manner and without disturbing the packoff anchor. This operation is the same as it would be in a common well having side pocket mandrels therein which form a part of the tubing string. However, in this case, the side pocket mandrel is installed entirely within the tubing string. For instance, the well tubing 24 may be 5½ inch outside diameter pipe while the side pocket mandrels 40 and 42 may be a 3½ inch size, in which case these side pocket mandrels would normally be adapted to receive 1½ inch flow control devices.

It should be understood that a well such as well 20 ordinarily will be completed with mud or other liquid left in the annulus above the packer 28 and that this mud or liquid must be removed before the well can be placed on gas lift. If such is the case, after the lower stop 44 is installed in the tubing, a circulating plug (not shown) is placed on top of the lower stop 44 to prevent downward flow therepast. The perforator gun mentioned before would then be placed on top of the circulating plug, and the first perforation such as perforation 46 would be accomplished. After removing the perforator, a cleaning fluid such as water would then be pumped into the tubing at the surface, which fluid would flow through the perforation and force the mud or other undesirable fluid in the annulus upwardly to the surface. This fluid could not pass downwardly below the circulating plug resting on top of the lower stop 44. After clean water was thus circulated through the well to remove the mud or undesirable fluid, the circulating plug (not shown) would be removed, the lower packoff anchor 42 would be installed followed by setting of the upper stop 52, and the next higher perforation subsequently made. Of course as the next higher perforations were made, the circulation of clean water therethrough would not be necessary, the well already having been cleansed as previously described.

After all gas lift equipment was installed, lift gas would be injected as before described and the well would need to be kicked off. For this operation, the liquid in the tubing-casing annulus above the perforations would be U-tubed through the gas lift valves into the tubing and would be produced therefrom at the surface. As the gas moved downwardly in the tubing-casing annulus, thus depressing the column of liquid therein, and as this liquid would be produced from the surface, there would come a time when gas would enter the uppermost perforation (in this case, perforation 46*a*) and would aerate the column of water in the tubing. Thus aerated, the water/gas mixture would be less dense and would rise to the surface in the well-known manner. As the liquid would be produced from the well, the liquid level in the tubing-casing annulus would subside until lift gas would enter the next lower perforation and more liquid would be produced. Finally, the water from the annulus would be gotten rid of, the liquid level in the annulus would be at the level of the lowest perforation and the lowermost gas lift valve would then control the flow of gas from the annulus into the tubing.

It is understood that in most cases, the gas lift valves will be adjusted and spaced so that as the well is kicked off, each valve after it has finished its work will close so that lift gas from the annulus will not be wasted by allowing it to pass therethrough into the tubing. In this manner, the lowest valve which can operate will do the work.

It is readily understood that not only can the flow control devices be selectively removed and replaced from any or all of the side pocket mandrels without disturbing the side pocket mandrels, the side pocket mandrels, too, can be removed and replaced although not in any selected order. For this operation, all of the side pocket mandrels above the one which needs replacing would have to be removed and later replaced in order from the bottom upward. Great care should be taken to replace the packoff anchors so that the lateral ports of the side pocket mandrels would be communicated with their respective tubing perforations.

The first form of the apparatus to be described will be that in which the packoff anchor comprises three parts: the side pocket mandrel with seals, and the upper and lower stops. Such apparatus is illustrated in FIG. 2A–3.

Figure 2A:
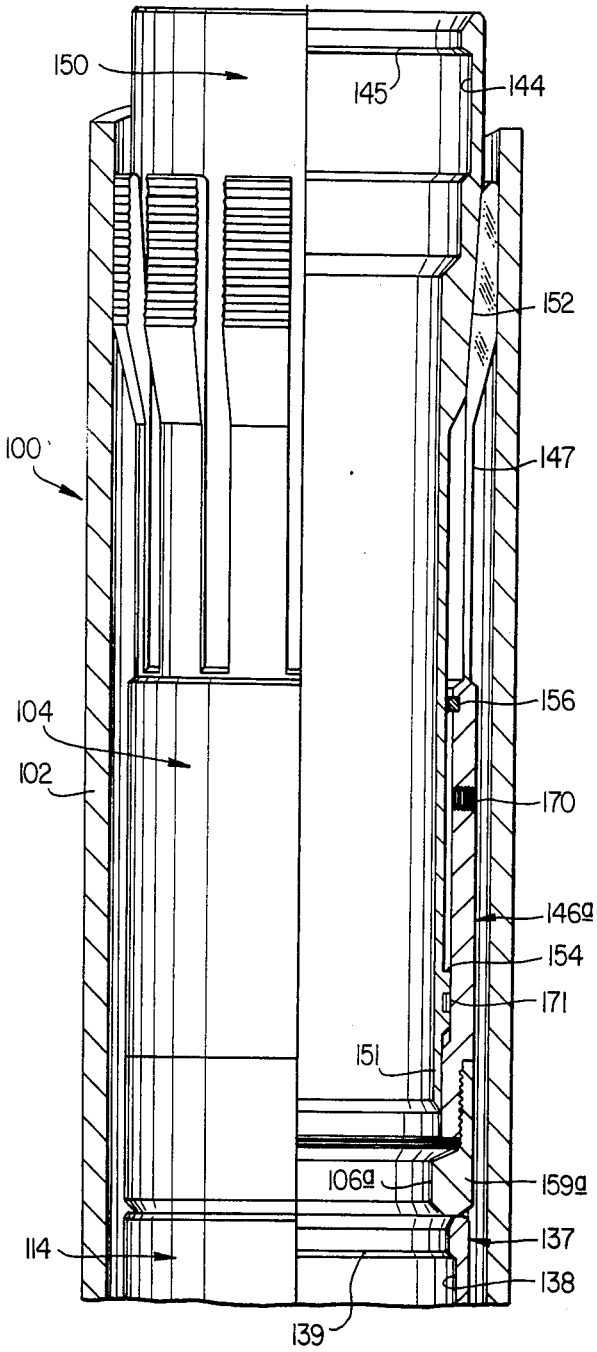
Figure 2C:
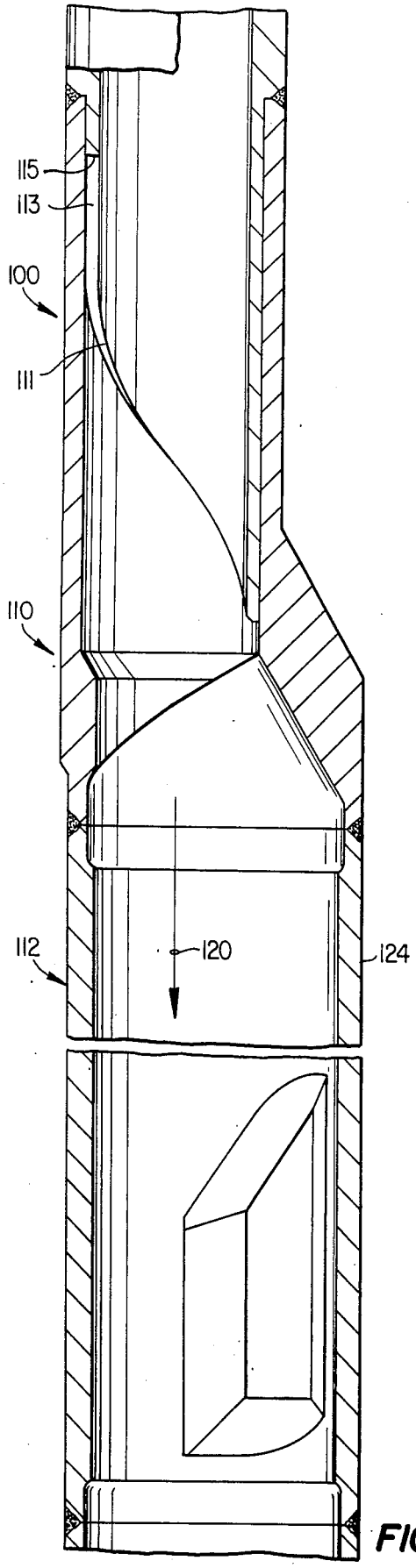
Figure 2B:
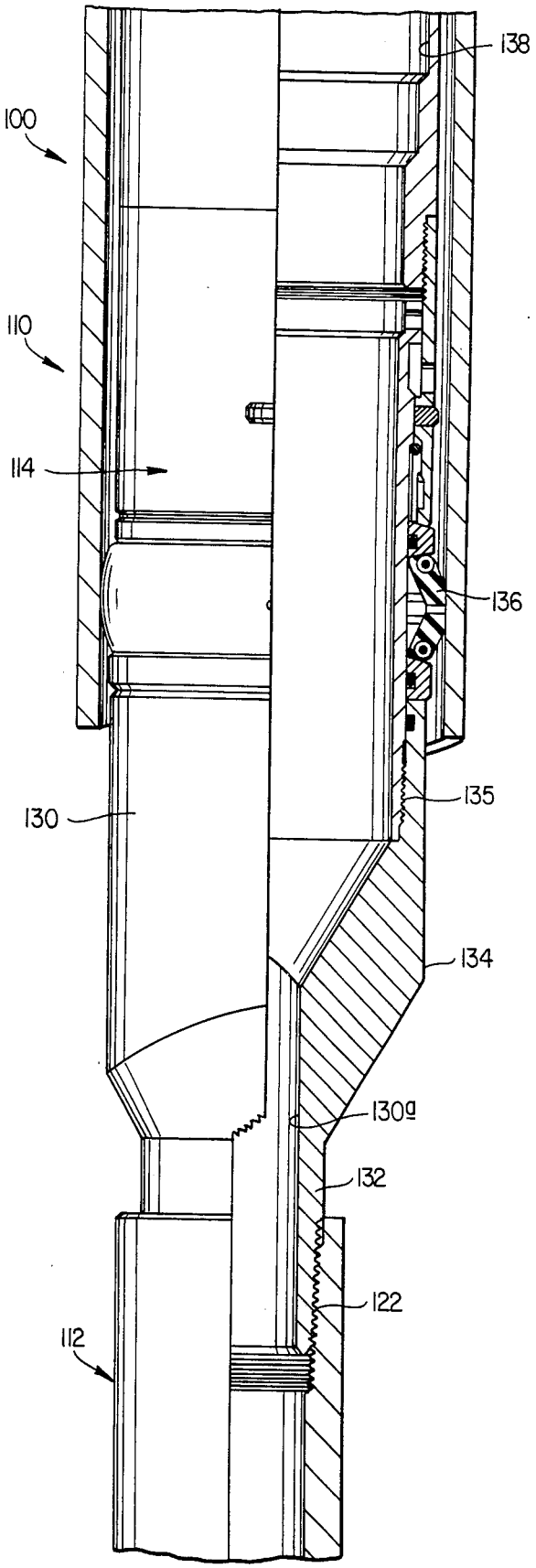
Figure 2D:
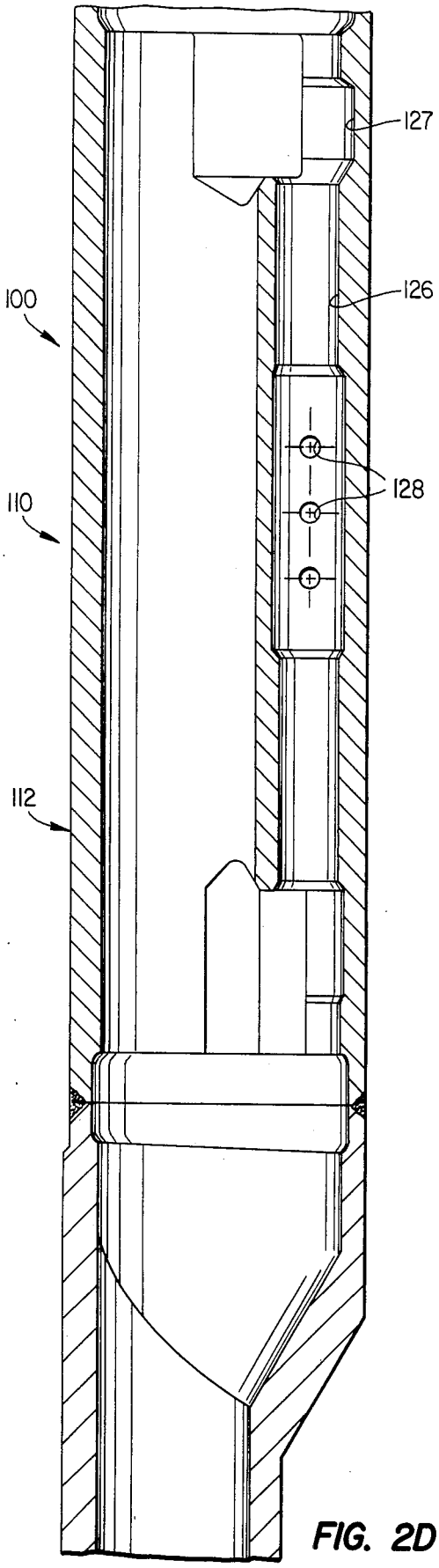
Figure 2E:
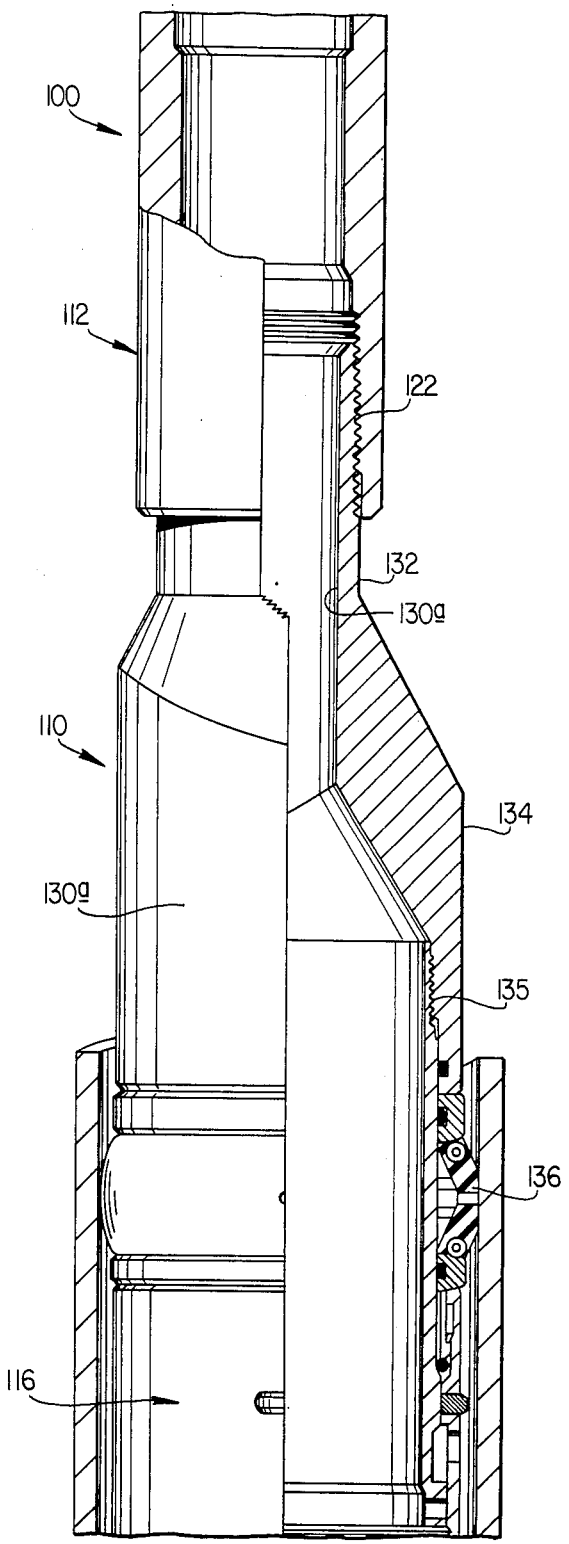
Figure 2F:
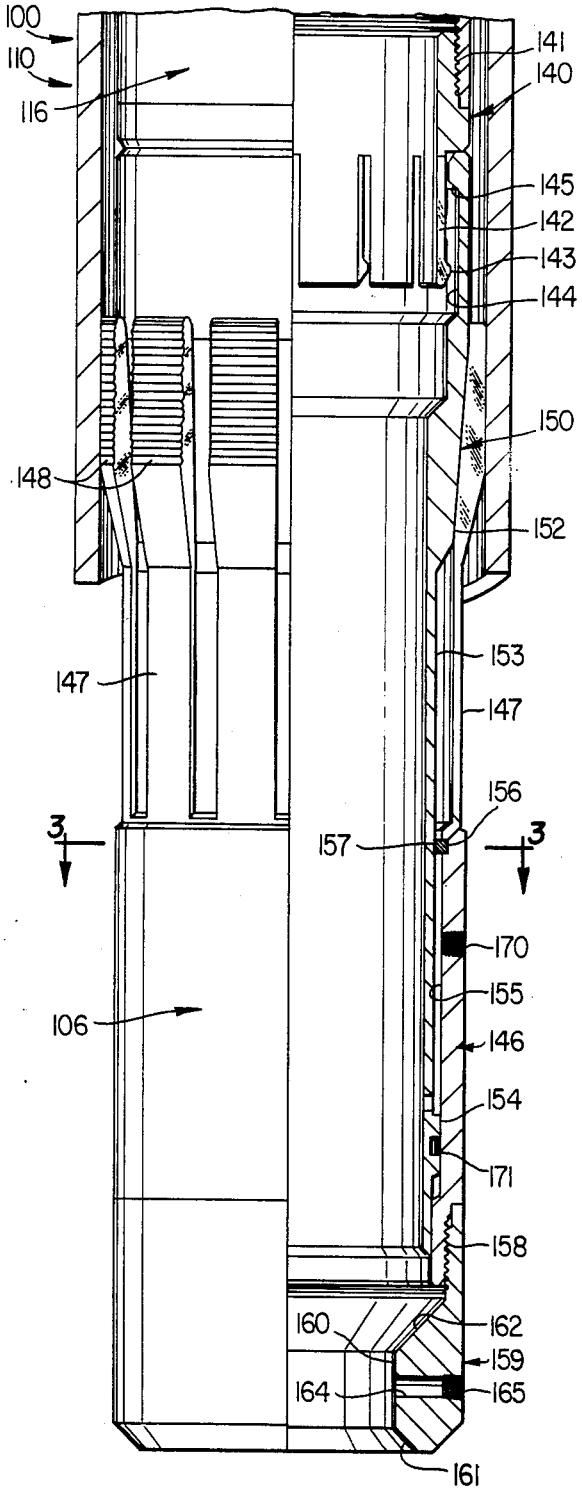
Figure 3:
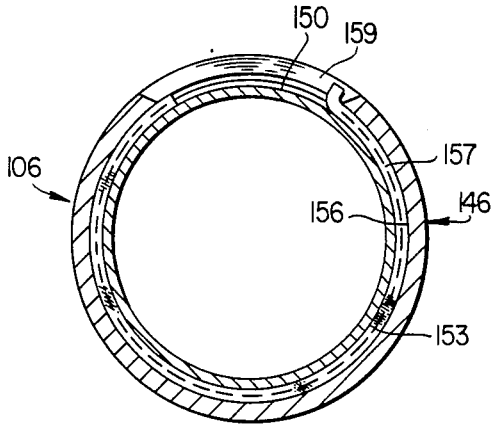
Figure 4A:
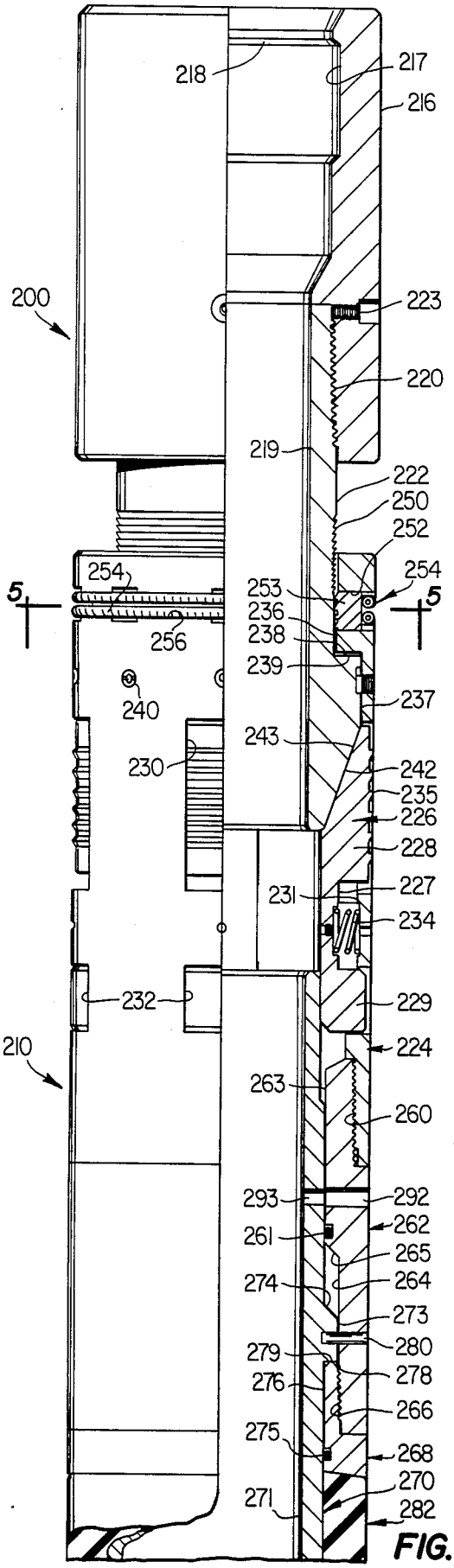
Figure 4B:
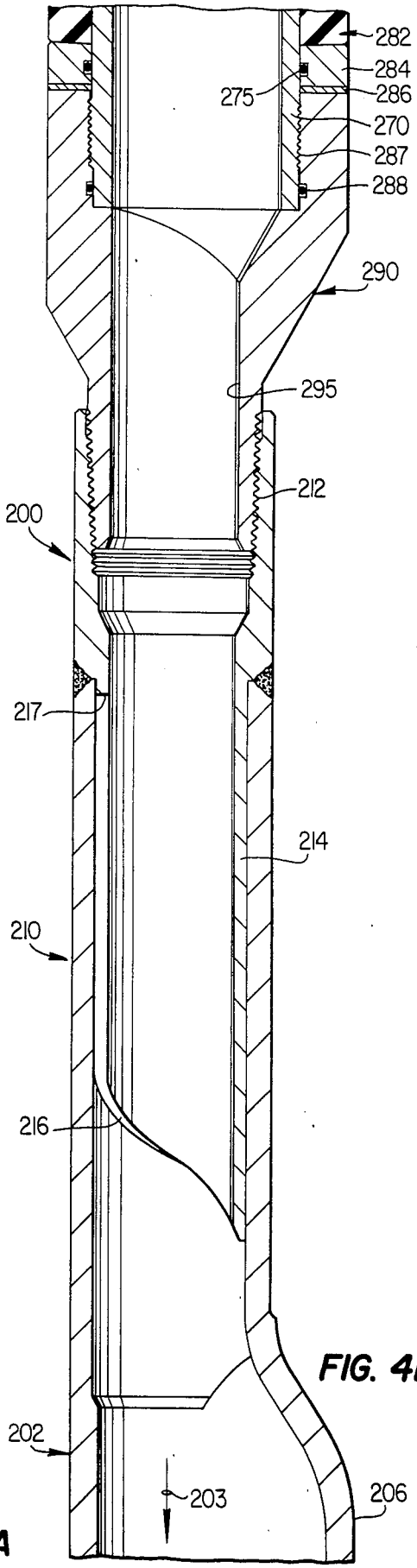
Figure 4C:
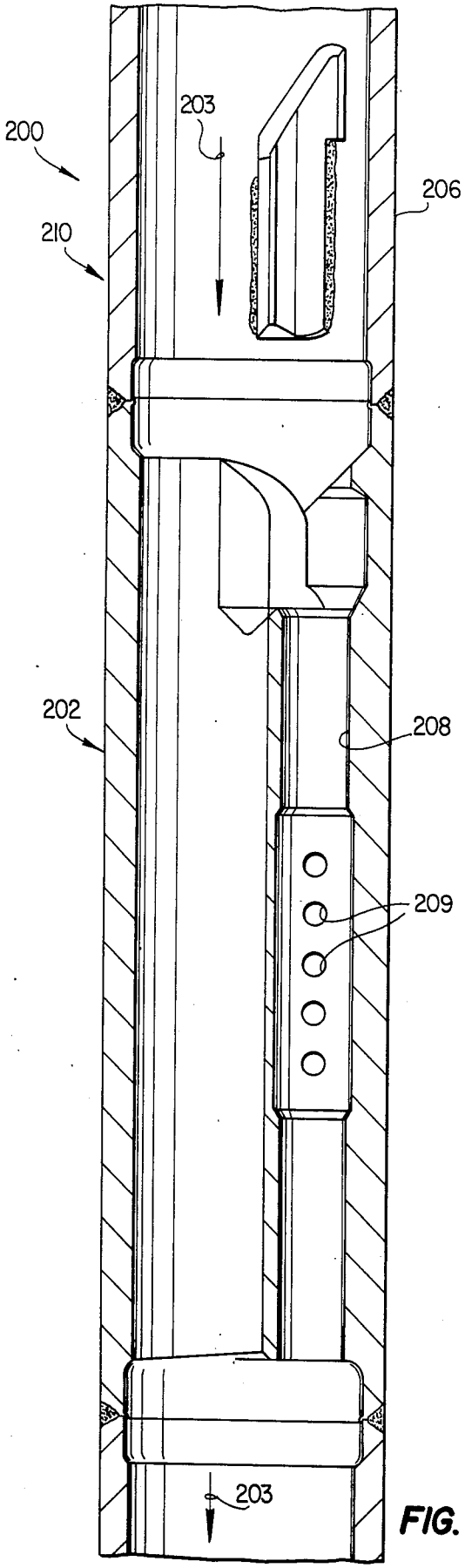
Figure 4D:
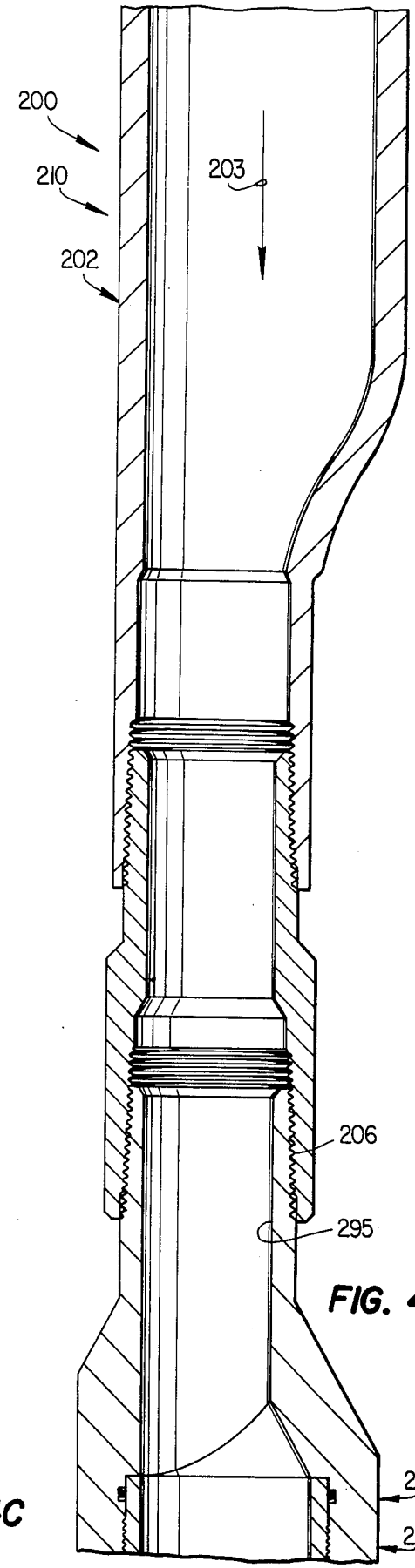
Figure 4E:
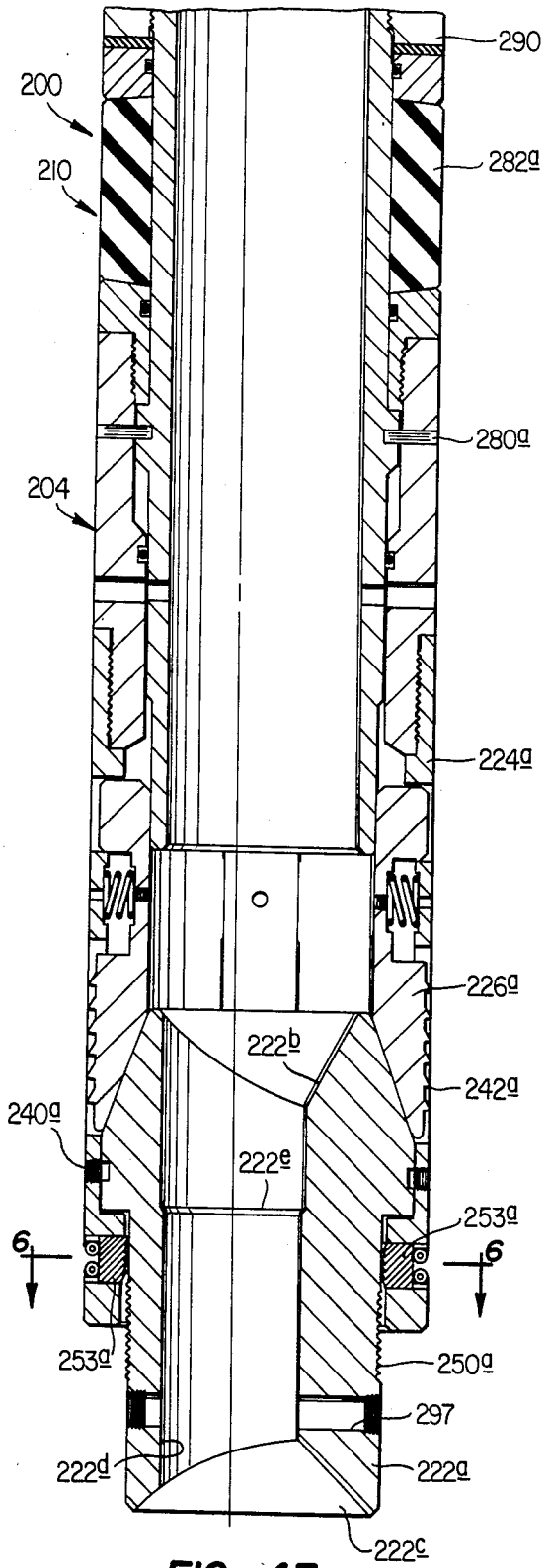
Figure 5:
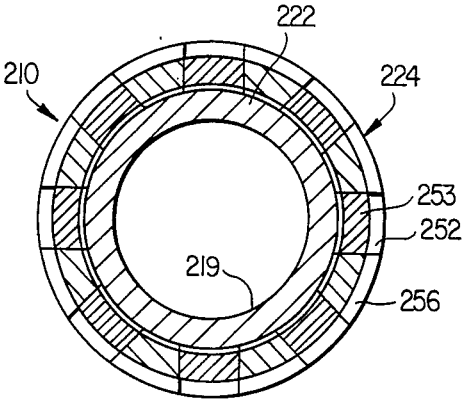
Figure 6:
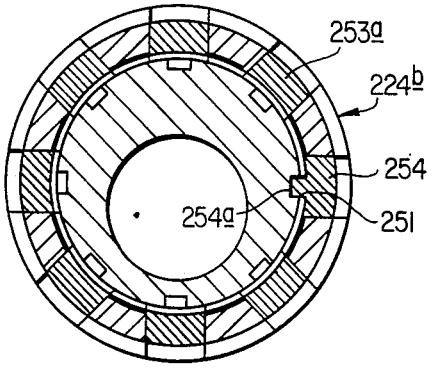

In FIGS. 2A–3, there is shown a packoff anchor assembly complete with stops, which equipment is suitable for converting a well to gas lift operation as will be explained. Referring now to FIGS. 2A–3, it will be seen that a packoff anchor assembly 100 is installed in the well tubing 102 and that it consists of a packoff anchor 110 secured in the tubing between securing means such as upper stop assembly 104 and lower stop assembly 106 and cannot move up or down. The packoff anchor 110 includes a side pocket mandrel 112, and upper and lower seal means such as upper seal assembly 114 and lower seal assembly 116.

In the embodiment shown in FIGS. 2A–3, the device is installed in the well in three sections as previously explained, the lower stop 106 being set first, the packoff anchor 110 being set on top of the lower stop to be supported thereby, and the upper stop 104 being then set on top of the packoff anchor to prevent upward displacement thereof.

The side pocket mandrel 112 may be of any suitable type. Preferably, it should be of the wireline orienting type, having an orienting sleeve therein above the belly. The particular one shown in this application is structured generally after that which is illustrated and described in U.S. Pat. No. 4,333,527 mentioned previously.

The side pocket mandrel 112 has a main bore extending therethrough which is indicated by the arrow to which the reference numeral 120 is applied. At opposite ends of the main bore 120, thread means 122 are provided for attachment to the upper and lower seal assemblies 114 and 116 as shown. Intermediate its ends, the side pocket mandrel is provided with a belly 124 which is offset to the right-hand side as seen in the drawing. A receptacle bore 126 extends alongside the main bore 120 and opens upwardly into the belly so that flow control devices, such as gas lift valve 55 may be inserted in or removed from such receptacle bore. The receptacle bore 126 is provided with a lock recess 127 and lateral ports 128, which ports communicate the receptacle bore with the exterior of the side pocket mandrel.

Since the belly 124 of the mandrel extends to one side only, the main bore 120 of the side pocket mandrel is not concentric with the seal assemblies connected to its ends. For this reason, an adapter sub 130 is attached between each seal assembly and the side pocket mandrel. Each adapter sub 130 is provided with an eccentric pin 132 having threads for connecting into the thread 122 at the end of the side pocket mandrel. The end of each sub 130 opposite the side pocket mandrel is enlarged as at 134, and its bore 130*a* is enlarged and threaded as at 135 for attachment to the end of the seal assembly 114 or 116 as shown. The large concentric bore at the large end of the sub 130 is blended into the eccentric bore at its small end so that tools may pass freely through the assembly in either direction.

The upper and lower seal assemblies 114 and 116 are well-known items and are illustrated and described in U.S. Pat. Nos. 3,215,208 and 3,278,192 referred to above.

Suitable seal assemblies, side pocket mandrels, stop assemblies, and circulating plugs are available from Otis Engineering Corporation, Dallas, Tex.

The upper end of the upper seal assembly 114 is provided with a fishing neck 137 having an internal annular recess 138 providing a downwardly facing shoulder 139 which is engageable by a running or pulling tool by which the device is run into or withdrawn from the well tubing. The lower end of the lower seal assembly 116 is provided with a collet 140 threaded thereto as at 141 and having dependent collet fingers 142 having exterior bosses 143 thereon which engage in the internal annular recess 144 below the downwardly facing shoulder 145 of the lower stop assembly 106 to yieldably attach the packoff anchor 110 to the lower stop assembly 106 as shown.

The lower stop assembly 106 has a slip member 146 having upstanding slip fingers 147 which are thickened at their upper ends and provided with external teeth 148 which are adapted to bitingly engage the internal wall of the tubing. Telescoped within the slip member 146 is the expander member 150 having an enlarged upper portion which tapers downwardly as at 152 and has its outside diameter reduced as at 153. Near its lower end, the expander member 150 is provided with an external annular flange as at 154 as shown which is a sliding fit in bore 155 of the expander member. Just below the lower ends of the slip fingers, the slip member 146 is provided with an internal annular groove 156 in which is disposed a square retainer wire 157 which is better seen in FIG. 3. The square retainer wire 157 more than fills the internal annular recess 156 of the slip member and will interfere with the external flange 154 on the expander member to limit upward movement thereof relative to the slip member 146. When the stop assembly is assembled, the expander is telescoped into the slip member, and then the retainer wire 158 is inserted through the window 159 in the side of the slip member and is forced to follow the internal annular recess therearound as shown. Prior to running the stop 106 into the well, its expander is lifted to its upper position and releasably retained in such position by a shear screw 170 having its inner end engaged in the external recess 172 of flange 154 on expander 150. The lower stop assembly 106 is threaded as at 158 for attachment of the end piece 159 whose bore is reduced as at 160, and this bore is approximately equal to the minimum bore through the packoff anchor assembly. The bore 160 of the end piece 159 flares downwardly at 161 and upwardly at 162 to provide ample guide surfaces so that tools may be passed therethrough readily. A shear pin hole 164 is formed transversely in the end piece 159 and intersects the reduced bore 160 intermediate its ends. The exterior ends of the shear pin hole 164 are threaded as at 165 for attachment of retainer screws for holding a shear pin (not shown) in place. The shear pin is used to releasably attach the lower stop assembly 106 to a suitable running tool such as a suitable setting gun, for instance the electrically detonated, powder charged setting gun illustrated and described in U.S. Pat. No. 2,687,775. Upon detonation, the powder charge in the setting gun generates a great quantity of pressurized gas which acts in a piston and cylinder arrangement to apply opposed axial forces to the stop assembly tending to compress it longitudinally. The setting gun is provided with a shoulder which is engaged with the upper end of the expander member 150 of the stop assembly and is further provided with a prong which extends downwardly through the stop assembly and is attached to the end piece 159 by a shear pin (not shown) disposed in the shear pin hole 164. Initially, when this shear pin is intact, the slip member 146 is at its lowermost position relative to the expander member and the fingers 147 are retracted. The setting gun and lower slip assembly are lowered into the well on an electric cable, and when the setting depth is reached, their descent into the well is stopped and an electrical current is sent through the electrical cable to the setting gun causing it to fire. The setting force applied to the shear pin lifts the slip member relative to the expander member, thus shearing shear screw 170 and further lifting the slip member 146 relative to the expander member 150. This force builds to a predetermined value, at which the shear pin fails and the setting gun is released for withdrawal from the well, leaving the lower stop assembly firmly secured in place in the well tubing.

The upper stop assembly 104 is very similar in structure to the lower stop assembly 106, just described. The upper stop assembly includes an expander member 150 which is exactly like the expander member 150 of the lower stop assembly 106. This expander member has an internal fishing recess 144 providing a downwardly facing shoulder 145 near the top of the expander for engagement of a running or pulling tool and is provided also with an external flange 154 near its lower end which is engageable with retainer wire 156 to limit its upward movement. The slip member **146*a* is similar to slip member 146 of the lower slip assembly 106 but has end piece 159*a* which differs from the end piece 159 of the lower stop assembly. End piece 159*a* has a large concentric bore 160*a* which is approximately equal in size to the bore 151 through the expander member, and there is no shear pin hole in the end piece 159*a*** because this upper stop assembly is not run on a setting gun, as was the lower stop assembly. Instead, the upper stop assembly is run on a suitable running tool such as the Otis Type GS running and pulling tool, as will be explained.

After the lower stop 106 has been installed and the well tubing has been perforated, the packoff anchor 110 is lowered into the well tubing on an Otis Type GS running and pulling tool. This running and pulling tool has dogs which engage in the recess 138 and downwardly facing shoulder 139 and supports the packoff anchor as it is run into the well. The packoff anchor is set atop the lower stop assembly 106 and downward force is applied as by jarring impacts to compress the upper and lower seal assemblies 114 and 116 longitudinally. This causes the upper and lower seals 136 to be expanded laterally into sealing engagement with the inner wall of the well tubing above and below the tubing perforation. When the seal assemblies are thus compressed longitudinally, they expand laterally and are then locked thus expanded, but the seals may be retracted by extending the seal assemblies to their initial running position, all as illustrated and described in the aforementioned U.S. Pat. Nos. 3,215,208 and 3,278,192 incorporated herein as mentioned above. The downward jarring utilized in setting the packoff anchor also shears a pin in the running tool and releases it for withdrawal from the well.

After the packoff anchor 110 has been set in place upon the lower stop 106 and its seals expanded, the upper stop assembly 104 is run into the well on the same Type GS running and pulling tool. The upper stop is set on top of the packoff anchor and downward jarring impacts are utilized to shear the shear screw 170 and drive the expander 150 down relative to the slip fingers 147 to expand them into position with their teeth 148 bitingly engaged with the tubing. This downward jarring shears the pin in the running tool and releases it for withdrawal from the well. Thus, the upper stop assembly is left locked in position securing the packoff anchor against upward movement while it is supported on the lower stop against downward movement in the well tubing. Thus, the packoff anchor is securely held between the upper and lower stops so that the lateral flow ports 128 of the side pocket mandrel are in fluid communication with the tubing perforation, the upper and lower seals 136 sealingly engaging the inner wall of the tubing above and below both the tubing perforation and the side pocket mandrel's lateral flow ports.

If a gas lift valve is not in the side pocket mandrel, one is installed at this time. The gas lift valve or flow control device is lowered into the well on a string attached to wireline tools including a suitable kickover tool and running tool. The kickover tool should be of the orienting type having an orienting key which will engage and cooperate with the guide surface 111 located above the belly 124 in the side pocket mandrel 112. As the orienting key on the kickover tool follows the guide surface 111, it is guided into the longitudinal slot 113, to subsequently engage downwardly facing shoulder 115 at the upper end of the slot or at the upper end of the guide surface 111, as the case may be. Further upward movement of the kickover tool causes the kickover tool to become activated in the well-known manner and will swing the gas lift valve attached thereto laterally to a position of alignment with and just above the offset receptacle 126 of the side pocket mandrel. Lowering of the wireline tools will then insert the gas lift valve into the receptacle 126 where it is secured in place with lock means thereon engaged in lock recess 127 in receptacle bore 126, also in the well-known manner. The wireline tools are then removed from the well, after which lift gas is injected into the well annulus at the surface. This lift gas travels downwardly in the annulus and passes through the tubing perforation and through the lateral flow ports 128 of the side pocket mandrel, through the gas lift valve in receptacle bore 126, and into well tubing for aerating the column of well fluids therein to aid in lifting them to the surface.

Should it become necessary to remove the gas lift valve or flow control device from the side pocket mandrel for repair or replacement, the same kickover tool and wireline tools used to install the device in the side pocket mandrel may be used to withdraw the device therefrom, the only difference being that the running tool on the kickover tool must be replaced by a pulling tool.

If several side pocket mandrels such as that described hereinabove are disposed in a well, any selected gas lift valve in the plurality of side pocket mandrels may be removed in the manner just described since the wireline tools and the kickover tool may be lowered through any of the side pocket mandrels.

To remove the packoff anchor 110 from the well, it is first necessary to remove the upper stop assembly 104. To remove the stop assembly 104, a suitable pulling tool is lowered into the well on a wire line and tool string to engage the recess 144 near the upper end of the expander 150 after which upward jarring is applied thereto to withdraw the tapered cone section 152 from between the upper ends of the slip fingers 147. The expander 150 will then be lifted until the upper side of external flange 154 of the expander engages the lower side of the retainer ring 156 and further upward movement of the expander will lift the slip member with it. Thus, the upper packoff anchor stop 104 may be lifted from the well. One suitable pulling tool which may be used in removing the stop assembly 104 from the well is the Otis Type GS pulling tool which is available from Otis Engineering Corporation, Dallas, Tex. The Otis Type GS pulling tool is equipped with retractable dogs with external bosses thereon which will engage in the recess 144. These external bosses on the pulling tool dogs will engage the downwardly facing shoulder 145 at the upper end of recess 144 of the expander when upward jarring impacts are delivered through manipulation of the wireline tools to withdraw the expander 150 from the slip fingers 147.

To remove the packoff anchor 110, the same Otis Type GS pulling tool is lowered into the well and is engaged with the recess 138 at the upper end of the upper seal assembly 114 in the same manner that it engaged recess 144 in the upper stop assembly 104. When upward jarring impacts are delivered to the Type GS pulling tool, the exterior bosses on its fingers will engage the downwardly facing shoulder 139 at the upper end of the recess 138 and the upper portion of the packoff assembly will be lifted to its initial running-in position in which position the seal member 136 is permitted to relax, as taught in U.S. Pat. Nos. 3,215,208 and 3,278,192, supra. Continued upward jarring will lift the side pocket mandrel 112 and will extend and release the lower seal assembly 116 in the same manner that the upper seal assembly was released. Thus, the seal 136 of the lower seal will be allowed to relax, after which further upward movement of the side pocket mandrel will withdraw the collet fingers 142 on the lower end of the packoff anchor assembly from their engagement in the recess 144 in the upper end of the lower stop assembly thus permitting the entire packoff anchor 110 to be removed from the well.

If the lower stop assembly 106 is to be removed, the same Type GS pulling tool is lowered into the well again and is engaged with the recess 144 at the upper end thereof, after which upward jarring impacts are utilized to unlock the device in the manner before explained with respect to the upper stop assembly and withdraw it from the well.

It should be understood that if only the upper packoff anchor need be replaced, the lower packoff anchor stop 106 could be left in the well undisturbed.

It will noticed that since the side pocket mandrel has a belly 124 which extends to the right-hand side thereof in FIGS. 2C and 2D and that the main bore through the side pocket mandrel is therefore displaced to the left of the centerline of the tubing in which the packoff anchor is installed, while the seal assemblies must be centered in the tubing, it is important that the belly 124 on the side pocket mandrel be aligned with the corresponding bulge on the upper and lower seal assemblies. This alignment is accomplished by the makeup of the threaded connections between the seal assemblies and the side pocket mandrel. While only one threaded connection is shown between the side pocket mandrel and each seal assembly, it may be desirable to provide additional threads as by installing one or more subs or pup joints between the side pocket mandrel and each of the seal assemblies. The plurality of threads thus provided can be made up tight but also to a point where proper alignment is obtained in the packoff anchor assembly. If this alignment is not achieved within reason, it may not be possible to fit the packoff anchor assembly into the well tubing.

Thus, it has been shown that a three-piece packoff anchor assembly can be installed in a well to bridge across a perforation or opening in the wall of the tubing so that the seals of the packoff anchor assembly will seal above and below the perforation in the tubing. It has been shown that the lower stop assembly can be placed in proper relation to the perforation or that the perforation can be made in proper relation to the lower stop assembly, that the packoff anchor assembly can be supported on the lower stop, and that the upper stop can then be placed above the packoff anchor assembly to secure it in position and against displacement therefrom. Thus, the lower stop supports the packoff anchor assembly against downward movement, and the upper stop will prevent its upward movement. Gas lifting operations are then carried on in the well-known manner.

Another form of the invention is shown in FIGS. 4A through 6. This form of packoff anchor assembly can be run into the well in one trip using an electrical conductor line and a suitable setting gun.

Referring now to FIGS. 4A–6, it will be seen that the packoff anchor assembly 200 includes a side pocket mandrel 202 having securing means in the form of the locking and sealing assembly 204 attached to its lower end as by thread 206 and having similar securing means such as the locking and sealing means 210 attached to its upper end as by thread 212. The side pocket mandrel 202 may be of any suitable type but is preferably of the orienting type as was before explained, and may be identical to the side pocket mandrel 112 described above with relation to the packoff anchor assembly 110.

The side pocket mandrel 202 has a main bore 203 extending through its full length, a belly 206 offset from the main bore, and a receptacle bore 208 which is offset from and extends alongside the main bore 203 and which opens upwardly into the belly. A plurality of lateral flow ports 209 are provided in the wall of the receptacle bore to communicate the receptacle bore with the exterior of the mandrel. The receptacle bore is adapted to receive a flow control device such as a gas lift valve or the like for controlling the flow of fluids through the flow ports 209. An orienting sleeve 214 having a guide surface 216 ending with a downwardly facing shoulder 218 is provided in the upper portion of the side pocket mandrel for orienting a kickover tool used in installing flow control devices in the receptacle bore or for removing them therefrom in the well-known manner.

The upper locking and sealing assembly 210 comprises a fishing neck 216 having an internal recess 217 near its upper end providing a downwardly facing shoulder 218 for engagement of a suitable running or pulling tool, such as, for instance, the Otis Type GS running and pulling tool mentioned hereinabove. The fishing neck 216 is threaded as at 220 for attachment to expander 222, which connection may be secured by a locking screw 223. The expander 222 has its lower portion slidably disposed in housing 224 which carries a plurality of slip members 226. Each slip member 226 has an external recess 227 intermediate its ends providing an upper outwardly projecting portion 228 and a lower projecting portion 229. The upper projecting portion 228 is disposed in window 230 of the housing 224 while the lower projecting portion of the slip is disposed in window 232 of the housing. A spring 234 is disposed in the recess 227 of the slip and has its outer end bearing against the inner wall 231 of the housing between the windows 230 and 232. This spring places an inward bias on the slip member tending to move it to its retracted position (shown). The upper projecting portion of the slip is provided with external teeth 235 which do not project beyond the periphery of the housing when in their retracted position as shown. The slips are movable by the expander 222 to an expanded position wherein the teeth 235 project somewhat beyond the periphery of the housing and are bitingly engageable with the inner wall of the surrounding well tubing to secure the device in place as will be explained.

The expander 222 has its lower end enlarged as at 237 providing an upwardly facing shoulder 238 which is engageable with a corresponding downwardly facing shoulder 239 provided by internal flange 236 in the upper end of the housing 224 as shown. The enlargement 237 of the expander 222 is provided with suitable recesses which are engageable by the inner ends of shear screws 240. This prevents longitudinal movement of the expander in the housing and maintains the expander in the running position as shown. The enlargement 237 of the expander is tapered as at 242, and the inner upper corner of the slips 226 are correspondingly tapered as at 243 to provide expander surfaces which cooperate with the expander's tapered surface 242. These expander surfaces 242 and 243 may be planar but are for economic reasons preferably made frusto-conical. When a downward force of sufficient magnitude is applied to the upper end of the fishing neck 216, shear screws 240 will shear, and the expander 222 will be moved downwardly relative to housing 224, the tapered expander surface 242 thereon cooperating with the corresponding expander surface 243 on the slips, causing the slips 226 to move to expanded position (not shown).

The expander 222 is provided intermediate its ends with annular ratchet teeth 250 while the housing 224 is provided with a plurality of windows 252 above its internal downwardly facing shoulder 239, and these windows are provided with ratchet segments 253 movable radially therein and having their inward surface formed with teeth engageable with teeth 250 on the expander. Garter springs 254 are disposed in an external annular groove 256 in the housing and pass across the outward ends of such ratchet segments to apply an inward bias thereto to urge their teeth into engagement with those on the expander to lock the expander against upward movement. Thus, when the slips 226 are expanded by moving the expander down, these ratchet segments 253 being engaged with the teeth 250 on the expander 222 will not allow the expander to move back up to a position releasing the slips 226.

The housing 224 is internally threaded at its lower end as at 260 for attachment of the sub 262 as shown. The sub 262 is provided with a bore 263 which is enlarged at its lower end as at 264 providing a downwardly facing shoulder 265. The enlarged bore 264 is internally threaded as at 266 for attachment of the threaded backup 268.

A seal mandrel 270 having a bore 271 has an upper portion slidably disposed in the sub 262. A seal ring 261 seals between the sub and the mandrel. The seal mandrel has an external annular flange 273 providing an upwardly facing shoulder 274 which is engageable with the downwardly facing shoulder 265 in the sub 262 for limiting downward movement of the sub on the mandrel. The threaded backup 268 is screwed into the lower end of the sub 262 as shown and is provided with an internal seal ring as at 275 for sealing between the threaded backup and the exterior surface of the seal mandrel. The bore 276 of the threaded backup is approximately equal to the diameter of the bore 263 of the sub 262 while the external flange 273 on the seal mandrel provides a downwardly facing shoulder 278 which initially abuts the upper end of the threaded backup 268 when the packoff anchor is in the unset condition (shown). The engagement of these two shoulders 278 and 279 limits upward movement of the sub 262 on the mandrel. Upwardly facing shoulder 274 on the seal mandrel should not engage the downwardly facing shoulder 265 in sub 262 when the packoff anchor is set in the well since the sub must impart adequate stress to the seal member 282 before shoulders 265 and 274 meet, and before the setting gun is released. A shear pin 280 disposed in a suitable aperture in the sub 262 and having its inner end received in a suitable blind hole or dimple in the external flange 273 of the seal mandrel maintains the sub 262 in its upper position on the mandrel as shown while the packoff anchor 200 is being run into the well.

A suitable deformable resilient seal member is used to seal between the seal mandrel and the inner wall of the surrounding tubing. This deformable resilient seal member is indicated by the numeral 282 in the drawing. When the deformable seal member 282 is compressed longitudinally, it expands laterally to bridge the gap between the outer periphery of the packoff anchor and inner wall of the well tubing in a manner common to many well packers. A plain backup ring 284 is placed about the seal mandrel 270 below the seal member 282 and is provided with an internal seal 275 for sealing between the backup ring and the seal mandrel. In order to assure that proper expansion will be accomplished when the packoff anchor is installed in the well, it may be necessary to provide a shim such as the shim 286 of the proper thickness. If the gap between the exterior of the seal assembly and the interior wall of the tubing is to be quite large, the shim 286 will need to be quite thick in which case the seal member 282 will likely be somewhat expanded before it is run into the well.

The lower end of the seal mandrel 270 is threaded as at 287 for attachment to an eccentric adapter sub 290, and this connection is sealed by the seal ring 288. In order to make up the threaded connection 287, it will be necessary to rotate the seal mandrel 282 relative to adapter 290. To aid in this, the sub 262 is provided with at least one lateral hole through its wall which is indicated by the numeral 292, and the seal mandrel 270 is likewise provided with at least one lateral hole through its wall which is indicated by the numeral 293. By aligning these holes 292 and 293 and placing a pin punch or the like therein, turning of the sub will also cause turning of the seal mandrel.

The lower portion of the bore of the adapter 290 is eccentric as at 295, and its outer surface is reduced in diameter toward the lower end concentric about the eccentric bore 295. The lower end of the sub is externally threaded as at 212 as previously mentioned for attachment to the upper end of the side pocket mandrel 202.

The lower locking and sealing assembly 204 is almost identical to the upper packoff assembly 210 in that it is provided with the same locking and sealing mechanism and also with an identical adapter 290 by which it is attached to the lower end of the side pocket mandrel. The lower locking and sealing assembly is inverted with respect to the upper locking and sealing assembly.

The lower locking and sealing assembly 204 is provided with a housing **224*a* carrying slip members 226*a* which are radially movable in windows and an expander 222*a* which is telescoped into the housing and having an expander surface 242*a* thereon for expanding the slip members when the setting gun, attached to the expander by means of a shear pin (not shown) disposed in shear pin hole 297 and passing through a prong carried by the setting gun. As the setting gun lifts the expander 222*a* relative to the housing 224*a*, the shear pins 280*a* shear first and allow the seal 282*a* to be expanded to sealing position, then the shear screws 240*a* which normally maintain the expander in its running position (shown) shear, allowing the expander to move up and expand the slips into tight engagement with the well tubing. Finally, the axial force applied by the setting gun reaches sufficient magnitude to shear the pin in shear pin hole 297 of the expander and the setting gun is released from the packoff anchor for withdrawal from the well tubing. The expander cannot move away from its slip expanding position by virtue of the ratchet segments 253*a* being engaged with the ratchet teeth 250*a* on the expander 222*a***.

It should be noted that the shear screws **240*a* having inner ends projecting into blind holes in the expander 222*a* will maintain the expander oriented with its eccentric bore 222*d* aligned with the eccentric bores 295 of the upper and lower adapter subs 290. However, when the shear screws 240*a* become sheared, as when the setting gun is actuated, they are no longer effective to maintain such alignment. Of course, since the time between shearing of the shear screws 240*a* and the setting of the lower slips 226*a* is so short, it is not too likely that appreciable misalignment could occur. Nevertheless, should it be desired to eliminate such misalignment possibility, the expander 222*a* can be formed with a longitudinal groove or keyway such as groove 251 (FIG. 6) in which is engaged a key or lug 254*a* formed on lug 254 which is placed in one of the windows of the housing 224*a* in place of one of the ratchet segments 253*a***. Thus, proper alignment will be maintained at all times.

The ends of the eccentric bore through the expander **222*a* are flared or chamfered as shown as at 222*b* and 222*c*** to guide tools therethrough and prevent their becoming lodged against the expander.

The packoff anchor 200 is run into the well on an electrical conductor line and tool string including a setting gun. The setting gun is equipped with a long prong which extends downwardly through the entire packoff anchor assembly and has its lower end attached to the lower expander **222*a* by a shear pin disposed in the shear pin hole 297, the shear pin passing through the lower portion of the setting gun prong. The setting gun is provided with a downwardly facing shoulder which is engageable with the upper end of the fishing neck 216. When the setting gun is fired, the shoulder is forced downwardly toward the lower end of the prong, and since the prong is attached to the lower expander, the packoff anchor assembly 200 is compressed longitudinally. As these setting forces are applied axially to the packoff anchor assembly, shear pins 280 and 280*a* are overcome allowing the upper and lower seals 282 and 282*a* to be expanded to sealing position, then, when the stresses in the seals reach a predetermined value, the shear screws 240 and 240*a* fail, allowing the upper and lower slips 226 and 226*a* to be expanded to locking position. This setting force increases to a higher predetermined value at which the shear pin in hole 297** shears and the setting gun is then released for withdrawal from the well, leaving the packoff anchor firmly secured and sealed in the well tubing.

The packoff anchor is thus secured in place in the well tubing with the upper and lower seals 282 and **282*a*** expanded into sealing engagement with the tubing above and below the lateral flow ports of the side pocket mandrel and, at the same time, above and below the tubing perforation. In this position, it is easy to see that the lateral flow ports of the side pocket mandrel would be in direct communication with the perforation in the tubing.

The lower portion of the prong on the setting gun needs to be articulated such that its enlarged lower end portion will fit properly into the lower expander **222*a* without a tendency to tilt it in the tubing. Such tilting may interfere with proper operation of the locking and sealing assembly. This articulation could be readily provided by a pair of hinges spaced a few inches apart, the lower of which would preferably be near the upper end of the expander 222*a*, both hinges flexing in a common plane. This enlarged lower end portion of the prong needs to fit the bore of the expander rather closely to provide proper shear conditions so that predictable shearing will be provided. This same prong could serve as a pulling prong also if its enlarged lower portion is formed with an external flange at a spaced distance above its shear pin hole, providing a downwardly facing shoulder which would be spaced above upwardly facing shoulder 222*e* when running the packoff anchor but which would engage the upwardly facing shoulder 222***e* in the expander bore 222*d* for forcing the expander down to slip releasing position for the retrieving operation. An adapter sub may be required at the upper end of the prong to adapt it for use with a pulling tool, such as the Otis Type GS pulling tool.

To remove the packoff anchor 200 from the well, a suitable prong such as that just described having a suitable downwardly facing shoulder near its lower end is attached to the lower end of the Otis Type GS pulling tool and lowered into the well. The downwardly facing shoulder on the prong will engage the upwardly facing shoulder 222*e* in the lower expander and downward jarring impacts are utilized to drive the lower expander down to disengage it from the keys 226*a* to release them for movement toward contracted position and allowing the seal member 282*a* to contract, thus unlocking the lower portion of the packoff anchor from the well tubing. As the prong is driven downwardly, the dogs on the Otis type GS pulling tool will engage the fishing recess 217 at the upper end of the device, and after the lower locking and sealing assembly is released, upward jarring impacts are utilized to drive the upper expander upwardly and out of engagement with the upper slips 226, thus unlocking the upper locking and sealing device from its engagement in the well tubing and allowing the upper seal member 282 to contract. (The releasing of the lower locking and sealing assembly should not affect releasing of the upper locking and sealing assembly.) The device is now free to be lifted from the well.

It should be understood that either of the expanders, 222 or 222*a*, can be forced from its slip locking position to its slip releasing position only by shearing the ratchet teeth from the ratchet segments. For this reason, the ratchet segments, 253 or 253*a*, should be formed of brass or similar material having a shear strength which is adequate but not excessive.

Thus, although unlocking of the lower lock assembly should not effect the unlocking of the upper lock assembly, it may be preferable to provide the proper length in the pulling tool and proper length in the dogs of the pulling tool so that the pulling tool will actually engage in the fishing recess 217 before the lower slips are released. But, at the same time, recess 217 of fishing neck 216 must be sufficiently long to accommodate such lengthened dogs since downward jarring impacts should not be delivered through the dogs.

While the packoff anchor 200 may be removed from the well using the Otis Type GS pulling tool or other similar device which may be lowered into the well on any suitable wire line or cable, if the packoff anchor assembly 200 is to be reinstalled in the well, it would be preferable to remove it with tools lowered into the well on an electrical conductor line so that its position could be measured accurately. The packoff anchor could then be reset in the well in almost precisely its former location to assure that the seals thereof would again seal both above and below the perforation in the tubing.

It has been shown that a packoff anchor including a side pocket mandrel can be placed within the bore of a well tubing opposite a perforation or opening in the wall of the tubing and locked and sealed in position with seal means on the packoff anchor sealing above and below the perforation, so that the well can be produced by gas lift operation by injecting lift gas into the tubing-casing annulus at the surface, and that this gas will pass through the tubing perforation and through the lateral ports of the side pocket mandrel, then through a gas lift valve in the side pocket mandrel to exit into the flow stream in the tubing to aid in lifting well fluids to the surface. In the first case, the packoff anchor assembly was installed in three separate pieces. The first piece installed was a lower stop assembly, then the packoff anchor per se was placed on top of the lower stop, followed by an upper stop assembly which was placed on top of the packoff anchor to securely confine the packoff anchor in place between the upper and lower stop assemblies.

In the second instance, the complete packoff anchor assembly, comprising its locking and sealing mechanisms and side pocket mandrel, was run into the well in one piece and was set by a setting gun so that it was securely locked and sealed in place with its seal members sealing above and below the tubing perforation so that the well could be gas lifted in the aforementioned and well-known manner. In installing either of the packoff anchor assemblies just mentioned, certain methods are practiced.

Figures 7, 8, 9, 10, 11, 12, 13:
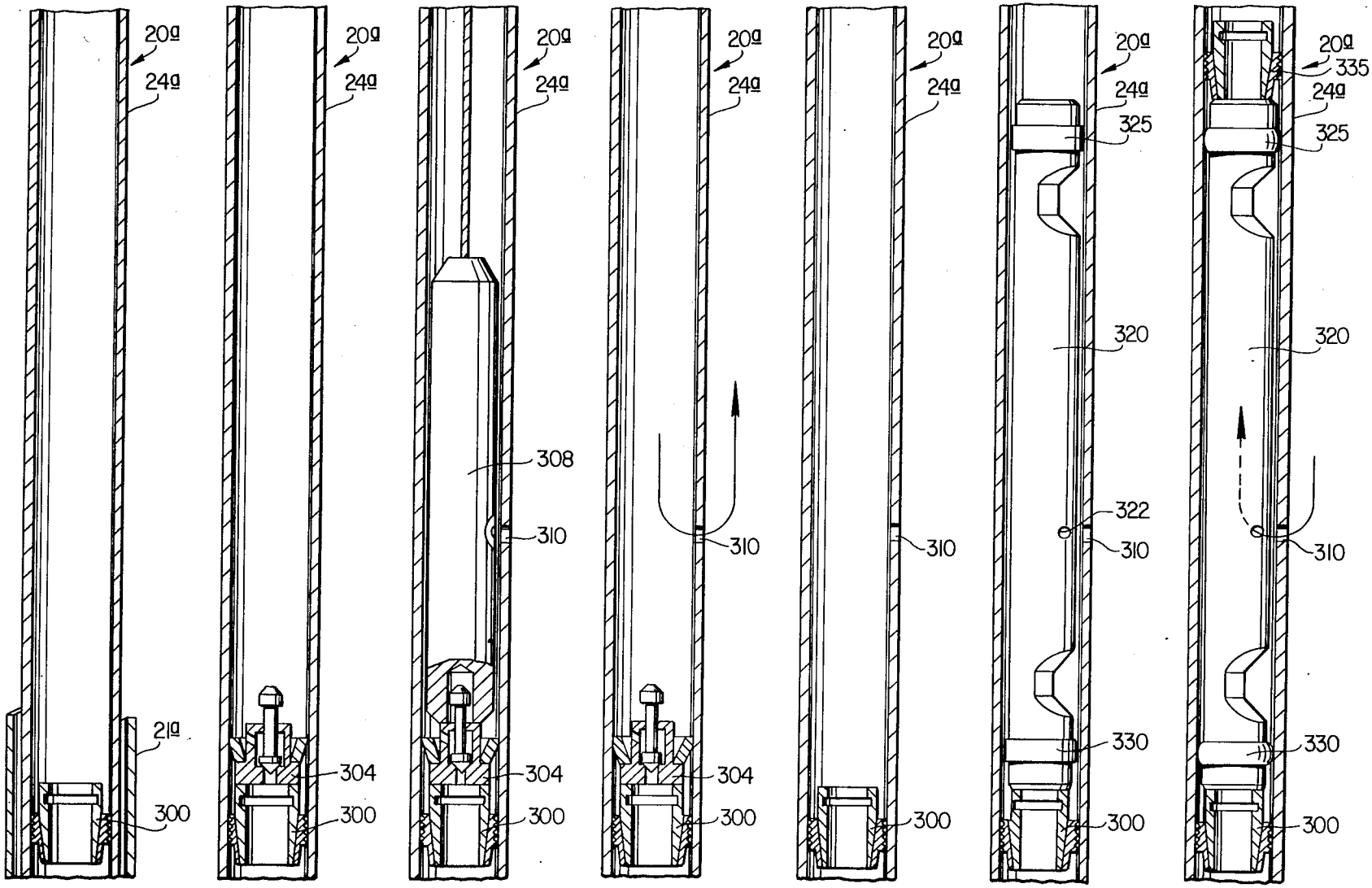

The first method to be explained is illustrated in FIGS. 7 through 13, where it will be seen that a method for converting a well to gas lift operation is illustrated. In FIGS. 7 through 13, only a fragment of the well is shown. It is understood that the well is of the general type shown in FIG. 1 and is indicated by the reference numeral 20*a*. In FIG. 7, the well 20*a* is provided with a well casing 21*a* within which is disposed a string of well tubing 24*a* as shown. The method illustrated here comprises lowering a stop assembly such as the stop assembly 300 into the well tubing and locking it in place as shown at the desired depth. The next step is that of lowering a circulating plug, such as the circulating plug 304, into the well tubing and setting it on top of the previously installed stop assembly 300 as shown in FIG. 8. After the circulating plug has been installed in the well, the next step is that of lowering a perforator such as perforator 308 into the well by suitable means and placing it on top of the circulating plug 304 to be supported thereby as seen in FIG. 9. The perforator 308 is thus supported on top of the circulating plug while performing the step of perforating the well tubing 24*a* to produce a perforation such as perforation 310 in the wall thereof a spaced distance above the stop 300 as shown. (If necessary, more than one perforation could be made, however, one is normally sufficient.) The perforator 308 is then withdrawn from the well. The next step comprises circulating a suitable cleaning fluid, generally water, salt water, or oil, through the perforation to clear the annulus above the perforation. Thus, cleaning fluid is pumped into the tubing at the surface and circulated down to the circulating plug 304 and through the perforation 310 to return to the surface, as seen in FIG. 10, thus displacing the undesirable fluids which are in the tubing-casing annulus. Such fluids are normally drilling mud left in the annulus when the well was completed. The cleaning fluid pumped into the tubing cannot pass downwardly beyond the circulating plug 304 and must exit the well tubing through the perforation 310 and flow into the tubing-casing annulus exterior of the tubing. Thus, the tubing-casing annulus is cleared of mud, or other unwanted liquid, down to the depth of the perforation.

After the tubing-casing annulus has been cleansed above the perforation 310, the next step is removing the circulating plug 304 from the well. The well as seen in FIG. 11 now is much like it was depicted in FIG. 7 with the exception that the tubing now has a perforation 310 and the tubing-casing annulus thereabove has been cleansed of undesired fluids. After cleansing of the tubing-casing annulus has been completed, the next step involves lowering a packoff anchor such as the packoff anchor 320 having at least one lateral flow port 322 into the well and placing it on top of the stop assembly 300. The running-in tool string is utilized to apply a downward axial force or downward jarring impacts against the upper end of the packoff anchor compressing the upper and lower seals 325 and 330, causing them to sealingly engage the inner wall of the tubing above and below the tubing perforation 310 as seen in FIG. 12. Since the lateral ports 322 are also between the upper and lower seals 325, they will communicate with the tubing perforation 310.

After the packoff anchor has been properly set, the next step is that of lowering an upper stop assembly 335 into the well tubing and setting it on top of the packoff anchor 320. This packoff anchor stop 335 should be against the upper end of the packoff anchor. Thus, the packoff anchor is confined between the upper and lower stop assemblies and cannot move up or down and neither can it relax and allow fluids to bypass its seals.

After the packoff anchor has been installed and secured in place by the upper stop assembly, the following step constitutes lowering a suitable gas lift valve into the well tubing on a suitable kickover tool and installing it in the receptacle of the side pocket mandrel so that it will control the flow of lift gas entering the side pocket mandrel through the lateral ports 322 thereof.

In FIG. 13, an arrow is used to indicate the flow of lift gas from the tubing-casing annulus through the tubing perforation and through the lateral flow ports into the gas lift mandrel, then upwardly through the well tubing. The gas lift valve inside the mandrel is not shown but must be there, as it is in FIG. 1, in order to control the entrance of gas into the tubing as is well-known in the art of gas lift operation of wells.

Thus, it has been shown that a conventional well such as well 20 of FIG. 1 can be converted to gas lift operation by performing the steps just outlined and by using the equipment that has been shown in FIGS. 2A through 3. If, however, the well which is to be placed on gas lift has clean fluids in the tubing-casing annulus such as gas, or oil, which need not be cleared out before gas lifting operations are begun, several of the steps explained above may be omitted. In this case, a shortened method may be practiced. This shortened method will now be explained.

The first step involves lowering a first stop assembly 300 into the well tubing **24*a* and anchoring it in position at the desired depth as seen in FIG. 7. The next step involves lowering a perforating gun such as perforating gun 308 into the well tubing and supporting it on top of the first stop assembly 300, then, while the perforating gun is thus supported on the first stop assembly 300, perforating the well tubing to provide the perforation 310. The perforator is then removed from the well. The subsequent step is that of lowering the packoff anchor 320 into the well and placing it on top of the first stop assembly 300, compressing it longitudinally by applying a downward force thereto to expand the upper and lower seals 325 and 330 thereon to seal both above and below the tubing perforation 310 (FIG. 12), as was before explained. The next step comprises lowering the second stop assembly 335 into the well and setting it on top of the packoff anchor 320, anchoring it in place as shown in FIG. 13. After the packoff anchor 320** has been thus installed in the well, gas is injected into the tubing-casing annulus at the surface. This lift gas passes through the tubing perforation and the lateral flow ports of the side pocket mandrel to enter the flow stream in the tubing to aid in lifting the well fluids to the surface as was before explained.

While the three-piece packoff anchor assembly as previously explained requires three trips into the well at least, this may be the preferred method and the preferred apparatus for some installations because it may utilize equipment which may be available readily or which may be already on hand.

The second embodiment of the apparatus involved a one-piece packoff anchor assembly which could be run into the well in a single trip. This too involves a method of converting a well to gas lift operation which will now be explained.

If the well which is to be placed on gas lift operation contains a clean fluid such as gas, oil or water in the annulus so that the cleansing operation can be omitted, the installation will be greatly simplified. Such simplified method is illustrated in FIGS. 14 through 16.

Figure 14:
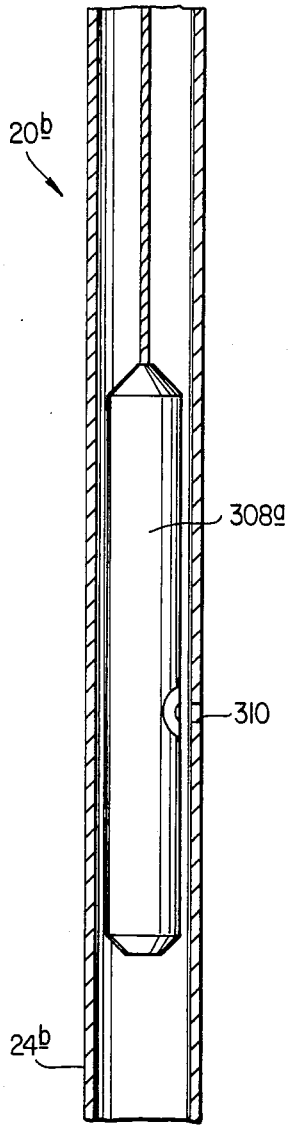
Figure 15:
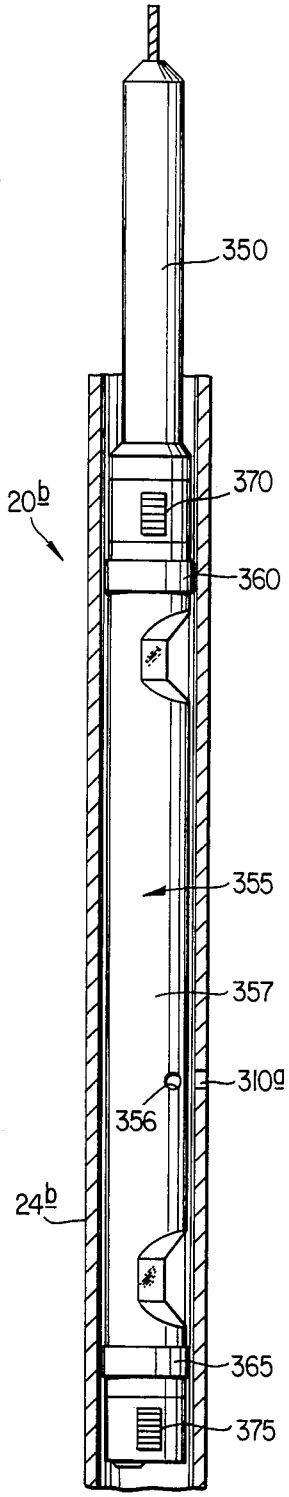
Figure 16:
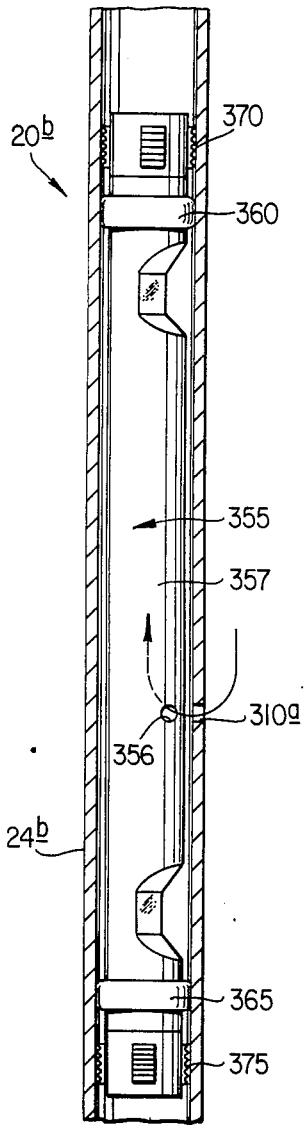

Referring now to FIGS. 14 through 16, it will be seen that another method of placing a well on gas lift is illustrated. Preferably, the method involves running the perforating gun into the well **20*b* on an electric line. The electric conductor line has very little stretch and can be used to measure depth very accurately. This method involves the steps of lowering a perforating gun into the well tubing on the electrical line to the desired depth, noting the depth of the perforating gun, transmitting electricity to the perforating gun causing it to fire, thus producing at least one perforation such as perforation 310*a* in the wall of the tubing 24*b* as shown in FIG. 15** and withdrawing the perforating gun from the well.

After the perforating gun has been retrieved, the following step involves connecting a setting gun 350 with a packoff anchor assembly 355 and lowering them into the well on the conductor line to such depth that the lateral flow ports 356 of the packoff anchor 357 are approximately opposite the perforation **310*a* in the wall of the tubing. While the packoff anchor assembly 355 is thus suspended at this depth, electricity is transmitted to the setting gun 350 from the surface, causing it to be activated so that it applies opposed axial forces to the opposite ends of the packoff anchor assembly, thus causing the upper and lower seal members 360 and 365 to be expanded into sealing engagement with the wall of the tubing and also causing the upper and lower slips 370 and 375** to be expanded into biting engagement with the wall of the well tubing to seal and anchor the packoff anchor assembly in place.

In FIG. 16, it is seen that the packoff anchor assembly 355 is locked by the upper and lower slips 370 and 375 so that it can neither move up nor down. At the same time, the upper and lower seals 360 and 365 are in sealing engagement with the inner wall of the well tubing above and below the perforation **310*a* so that lift gas which has been injected into the tubing-casing annulus at the surface travels downwardly therein and through the tubing perforation 310*a* into the gas lift mandrel 357 through the lateral port 356** thereof to enter the flow stream moving upwardly through the gas lift mandrel to aid in lifting well fluids to the surface in the well-known manner.

Where lift gas pressure is sufficient, only one gas lift valve is needed, generally. However, in either of the cases just described, the steps of the method can be repeated to install additional side pocket mandrels in the tubing above the first one which was installed therein. Additional gas lift valves are usually required in getting started with the gas lift operation where the well is loaded with liquids and the lift gas pressure in inadequate.

Since the electric conductor line makes possible very accurate depth measurements, it may be desirable, in wells requiring a plurality of gas lift valves and in which the tubing-casing annulus contains clean fluids, to make the required number of perforations during a single run of the perforator into the well, noting with care the depth of each such perforation and subsequently installing a packoff anchor such as packoff anchor 355 at each of the perforations made.

If in practicing the method illustrated in FIGS. 14 through 16, the well has mud or dirty fluid in the annulus, the annulus could be cleansed in the manner described hereinabove with respect of the three-piece packoff anchor installation. This would involve setting a stop assembly at the desired depth, followed by setting a circulating plug on top of the stop, and afterwards running the perforating gun into the well, resting it on top of the circulating plug and firing the gun to form a perforation through the wall of the tubing. Cleaning fluids would then be injected into the tubing at the surface to flow downwardly through the tubing to the perforation then upwardly through the annulus exterior of the tubing to lift the mud or dirty fluids to the surface to cleanse the annulus above the level of the tubing perforation. After cleansing the annulus, the circulating plug and the stop assembly would be removed from the well. This operation would then be followed by the running of the packoff anchor as shown in FIG. 15. The packoff anchor would be lowered to the depth of the perforation 310*a* and the setting gun fired to anchor the packoff anchor in place as shown in FIG. 16, after which the well could be placed on gas lift in the usual manner as before explained.

The foregoing description of the apparatuses, well installations, and the methods of placing wells on gas lift operation, and the drawings illustrating them are explanatory and illustrative only and are not to be taken in a limiting sense because various changes in sizes, shapes, arrangements of parts, variations in the methods steps or in their performance, as well as variations in details in construction may be made within the scope of the appended claims without departing from the true spirit and teaching of this invention.

We claim:

1. A packoff anchor for bridging a lateral opening in a well flow conductor, comprising:

(a) an elongate tubular body means including a side pocket mandrel having a lateral flow port in its wall and an internal receptacle for removably receiving a device for controlling flow through said lateral flow port, said receptacle being accessible to tools lowered through said well tubing and into said packoff anchor for installing a flow control device therein or removing such device therefrom; and (b) expansible seal means carried on said elongate body means above and below said lateral flow port for sealing with the inner wall of said well flow conductor above and below said lateral opening.

2. The packoff anchor of claim 1 including flow control means for installation in said receptacle for controlling flow through said lateral flow port.

3. The packoff anchor of claim 2 wherein said flow control means is a gas lift valve.

4. A device for controlling the flow of fluids through a perforation in the wall of a well tubing, comprising:

(a) a side pocket mandrel having an internal offset valve-receiving receptacle therein and a lateral flow port in its wall;

(b) seal means on said side pocket mandrel above and below said lateral flow port; and (c) means for securing said side pocket mandrel inside said well tubing with said seal means sealingly engaged therewith above and below said perforation.

5. The device of claim 4 wherein said seal means includes both upper and lower resilient seal means attached at the upper and lower ends of said side pocket mandrel.

6. The device of claim 5 wherein said securing means includes securing means mounted adjacent each of said upper and lower seal means.

7. The device of claim 4, 5, or 6 wherein said side pocket mandrel includes means for controlling flow through said lateral flow port, said flow control means being removably disposed said side pocket mandrel.

8. The device of claim 7 wherein said flow controlling means is a gas lift valve having upper and lower seals thereon, said gas lift valve being installable in said receptacle bore with said upper and lower seals sealing above and below said lateral flow port for controlling flow therethrough.

9. The device of claim 7 wherein said side pocket mandrel is provided with means for orienting a kick-over tool therein for installing a flow control device in said offset receptacle bore.

10. A well installation, comprising:

(a) a well having a well casing therein and a well tubing within said well casing, said well tubing having at least one perforation through its wall;

(b) at least one side pocket mandrel inside said well tubing and having a lateral flow port in its wall;

(c) seal means sealing between each said at least one side pocket mandrel and the inner wall of said well tubing above and below the corresponding one of said at least one perforation; and (d) means securing each said at least one side pocket mandrel inside said well tubing with its lateral flow port communicating with said corresponding one of said at least one perforation.

11. The installation of claim 10 wherein each said at least one side pocket mandrel is provided with means for controlling flow through its lateral flow port.

12. The installation of claim 11 wherein the means for controlling flow is a gas lift valve.

13. The installation of claim 11 or 12 wherein said flow controlling means in any selected one of said at least one side pocket mandrel is removable without disturbing the setting of either of said side pocket mandrels 5.

14. The installation of claim 10 wherein each said at least one side pocket mandrel is removable without disturbing said well tubing.

15. A method of preparing a well for gas lift or the like operation, said well having a well casing extending from the surface to a subsurface producing formation and a well tubing within the well casing, said well tubing having a flow passage therethrough said method including the steps of:

(a) providing at least one perforation in the wall of said well tubing at each of one or more selected longitudinally spaced-apart locations;

(b) disposing a side pocket mandrel, having a lateral flow port therein, inside said flow passage of said well tubing opposite each said perforation;

(c) sealing between said well tubing and each said side pocket mandrel both above and below the lateral flow port thereof; and (d) securing each such side pocket mandrel inside said well tubing with its lateral flow port in communication with the corresonding perforation.

16. The method of claim 15, including the additional step of: installing a flow control device in each side pocket mandrel for controlling the flow of fluids through the lateral flow port thereof.

17. The method of claim 16 wherein said flow control device is installed in each side pocket mandrel before the side pocket mandrel is lowered into the well tubing.

18. The method of claim 16 wherein said well tubing contains a plurality of side pocket mandrels and said method includes the further step of replacing a selected one of said flow control devices by use of tools lowered into the well tubing from the surface and without disturbing the setting of either of said side pocket mandrels.

19. The method of claim 15 including the step of removing one of said at least one side pocket mandrel without disturbing the well tubing.

20. The method of preparing a well for gas lift or the like operation, said well having a well casing extending from the surface to a subsurface producing formation and a well tubing inside the well casing and a packer sealing the tubing-casing annulus above said producing formation, said method including the steps of:

(a) lowering a first lock assembly into said well tubing and anchoring it therein at a desired location above said packer;

(b) setting a circulating plug in said well tubing and atop said first lock assembly to be supported thereby;

(c) lowering a tubing perforator into said well, resting said perforator atop said circulating plug, and actuating said perforator to form a perforation through the tubing wall, then retrieving the perforator from the well;

(d) circulating cleanout fluids down said well tubing to said circulating plug, thence outward through said perforation into the tubing-casing annulus, thence up through the tubing-casing annulus to the surface;

(e) retrieving the circulating plug from the well;

(f) lowering a side pocket mandrel having a lateral flow port in its wall and seals above and below its lateral flow port into the well tubing and setting it atop said first lock assembly with its seals sealing between the side pocket mandrel and the well tubing both above and below said perforation;

(g) lowering a second lock assembly into said well tubing and setting it atop said side pocket mandrel to secure the same in position with its lateral flow port in communication with said tubing perforation; and (h) installing a flow control device inside side pocket mandrel to control the admission of lift gas into the tubing from the annulus through said perforation and said lateral flow port.

21. The method of preparing a well for gas lift or the like operation, said well having a well casing extending from the surface to a subsurface producing formation and a well tubing inside the well casing, said method including the steps of:

(a) lowering a perforator into the well, forming a perforation in the wall of the well tubing at a selected location, and withdrawing the perforator from the well;

(b) lowering a side pocket mandrel, having a lateral flow port therein and seal means above and below said lateral flow port and securing means on at least one end thereof, into the well tubing and disposing it opposite said perforation;

(c) securing said side pocket mandrel in the well tubing with its seal means sealing above and below said perforation;

(d) repeating steps "a", "b", and "c" as many times as necessary to secure a side pocket mandrel at each desired location in ascending order; and (e) installing a flow control device inside each of said side pocket mandrels.

22. The method of claim 21 wherein said side pocket mandrel includes securing means at both its upper and its lower ends.

23. The method of claim 20, 21 or 22 wherein the step of installing said flow control device in each said side pocket mandrel is performed on the surface before said side pocket mandrel is lowered into said well tubing.

24. The method of claim 22 wherein said side pocket mandrel is installed in said well tubing using a setting gun lowered thereinto on an electrical conductor line.

25. The method of claim 21 or 22 wherein step "a" includes forming a desired plurality of longitudinally spacedapart perforations in the wall of the well tubing by a perforating gun lowered on an electrical conductor cable before performing step "b".

* * * * *